US005145489A

United States Patent [19]

Dunlop

[11] Patent Number: 5,145,489

[45] Date of Patent: Sep. 8, 1992

[54] METHOD FOR COPROCESSING COAL AND OIL

[75] Inventor: Donald D. Dunlop, Miami, Fla.

[73] Assignee: Fuels Management Inc., Miami, Fla.

[21] Appl. No.: 619,031

[22] Filed: Nov. 28, 1990

[51] Int. Cl.[5] ..... C10L 9/08; C10L 9/10

[52] U.S. Cl. ..... 44/626; 34/9

[58] Field of Search ..... 44/626; 34/9

[56] References Cited

U.S. PATENT DOCUMENTS

| | | | |
|---|---|---|---|
| 3,985,517 | 10/1976 | Johnson | 44/626 |
| 4,325,311 | 4/1982 | Beránek et al. | 44/626 |
| 4,504,274 | 3/1985 | Anderson | 44/626 |

*Primary Examiner*—Margaret Medley
*Attorney, Agent, or Firm*—Howard J. Greenwald

[57] ABSTRACT

A process for simultaneously improving the fuel properties of coal and oil is described.

In the first step of this process, two fluidized beds are provided. The first fluidized bed has a fluidized density of from about 20 to about 50 pounds per cubic foot and is at a temperature of from about 850 to about 1,000 degrees Fahrenheit. The second fluidized bed is similar to the first but is at a slightly higher temperature.

Coal and oil are fed into the first fluidized bed. A portion of the coal/oil mixture from the first bed is fed to the second bed, wherein it is combusted. Combustion product from the second bed is fed to the first bed.

7 Claims, 1 Drawing Sheet

METHOD FOR COPROCESSING COAL AND OIL

FIELD OF THE INVENTION

A process in which the fuel properties of coal and crude petroleum are simultaneously improved is described. In this process, the coal and crude petroleum (and/or the residual product from the conventional refining of crude petroleum) are contacted with each other while being subjected to a temperature of from about 850 to about 1,000 degrees Fahrenheit in a fluidized bed.

BACKGROUND OF THE INVENTION

The most abundant coal resource in western North America and Canada is the low rank coals, which include sub-bituminous coal and lignite. Many deposits of these coals are relatively easy to mine; but, unfortunately, they contain large amounts of moisture. High levels of moisture result in low calorific values for the coal. Coal with high levels of moisture not only costs more to transport, but substantially more if it must be combusted for a given heat output.

The higher-rank coals, many of which are found in the Eastern United States, suffer from another disadvantage—they often contain substantial amounts of ash. The ash, in addition to lowering the calorific value of the coal, will cause erosion of boilers when the coal is burned and pollution of the environment. Environmental regulations necessitate the use of expensive ash-recovery facilities.

A similar problem exists with crude oil, particularly heavy crude oils. There are substantial reserves of heavy crude oil in Western Canada and Venezuela; the reserves of heavy crude oil in Venezuela are believed to be at least equal to the known recoverable reserves of conventional crude oils in the rest of the world. This oil generally has an American Petroleum Institute ("A.P.I.") gravity of less than about 10. Petroleum refiners prefer to work with crude oils with an A.P.I. of at least about 20, for such oil is substantially more economical to process to much higher value products.

Processes for reducing the moisture content of coals are well known to those skilled in the art.

Thus, for example, in 1923, in U.S. Pat. No. 1,477,642, Benjamin Gallsworthy disclosed that certain low grade crude petroleums contained a substantial amount of moisture. Gallsworthy taught a process in which the oil was sprayed over heated lignite and allowed to percolate through the lignite. The lignite used in Gallsworthy's process had to be substantially moisture-free prior to the time it was contacted with the oil.

In 1926, in U.S. Pat. No. 1,574,174, Eugene Shoch disclosed a process in which fresh lump lignite is heated in a still while immersed in thin petroleum oil. Shoch taught that, in general, such lignite should not be heated to a temperature in excess of 300 degrees Centigrade, stating that (at page 1) "Fresh lignite . . . frequently contains . . . from 25% to 35% of moisture, which it loses when heated at 110 degrees C. . . . Heated above this temperature, to 300 degrees C., it gives up still more moisture, and some carbon dioxide; and heated still higher it begins to yield tar, and some combustible gases; the deepseated decomposition which it then undergoes involves an exothermic reaction so that the heating power of the products when used as a fuel is less than that of the original material . . . ."

In 1932, in U.S. Pat. No. 1,871,862, Eugene Shoch again disclosed that, when lignite is heated to a temperature in excess of 300 degrees Centigrade, it undergoes an exothermic reaction.

In 1939, yet another lignite dehydration patent was issued to Eugene Shoch. In U.S. Pat. No. 2,183,924, Shoch disclosed that lignite is subject to disintegration when it is dehydrated, stating that (at page 1) " . . . when lignite is heated in dryers or retorts to remove this moisture, it also undergoes such extensive disintegration." In the process of this patent, Shoch submerged the lignite under a hydrocarbon oil while maintaining both within a closed vessel, and he heated the contents of the closed vessel to a maximum temperature of from 200 to 220 degrees Centigrade.

In 1952, in U.S. Pat. No. 2,610,115, Henry Lykken disclosed a method for dehydrating lignite. In the first step of this process, the lignite was crushed and then screened to a size not substantially exceeding 1 inch mesh. Thereafter, the screened lignite was mixed with from 3 to 10 percent of a mineral hydrocarbon oil. Thereafter, the lignite/oil mixture was heated to a maximum temperature of 300 degrees Fahrenheit.

In 1957 Lykken was issued another lignite dehydration patent. In U.S. Pat. No. 2,811,427 he again disclosed a process in which a lignite/oil mixture was heated to a maximum temperature of 300 degrees Fahrenheit.

A third lignite dehydration patent (U.S. Pat. No. 2,966,400) was issued to Lykken in 1960. In the process of this patent, coarsely crushed and screened lignite was fed with a minor amount (3–10 weight percent) of fluidal hydrocarbon material into and through a rotary preheating kiln, and then into and through a rotary processing kiln in which the temperature of the lignite is raised to about 600 degrees Fahrenheit.

In 1972 U.S. Pat. No. 3,754,876 was issued to Robert E. Pennington et al. The patentees disclosed a process for removing water from sub-bituminous or lower rank coal in which the coal is contacted with a "stream of inert hydrogenpoor hydrocarbonaceous heat transfer fluid . . . ." At column 3, the patentees taught that the fluid used in their process must have a hydrogen-to-carbon ratio of less than 1.5. They also teach that petroleum oils, which generally have higher hydrogen-to-carbon rations (1.5 to 2.0), should not be used in the process of their invention.

In 1976, in U.S. Pat. Nos. 3,985,516 and 3,985,517, Clarence Johnson disclosed a process in which particulate pyrophoric low rank coal was contacted with from 0.5 to 5 percent of hydrocarbon liquid while in a fluidized bed and while being heated to a temperature of from 250 to 500 degrees Fahrenheit.

In 1980, in U.S. Pat. No. 4,213,752, Walter Seitzer disclosed a lignite dehydration process in which the coal was passed into a moving bed of hot coal at a temperature in the range of from about 200 to about 300 degrees Centigrade.

In 1982, in U.S. Pat. No. 4,309,192, Isao Kubo et al. disclosed a process for the treatment of "water-containing coal." In the first step of this process, a mixture of such coal and a hydrocarbon oil is provided. Thereafter, such mixture is heated at a temperature of from 100 to 350 degrees Centigrade.

In 1984, in U.S Pat. No. 4,461,624, Brian Wong disclosed a process for improving the calorific value of lowrank coal. In the first step of this process, the coal was crushed to a particle size of 0.1 to 3 centimeters.

Thereafter, the crushed coal was immersed in a distillation residuum of petroleum crude oil at a temperature of from 240 to 350 degrees Centigrade.

In 1985, in U.S. Pat. No. 4,504,274, Ardis Anderson disclosed that dried coal has a " . . . tendency toward spontaneous combustion . . . " which presents " . . . a serious problem during the shipment and storage of such coal . . . ." In the process of this patent, a "coal spray" is used to coat the dried coal.

In 1985, in U.S. Pat. No. 4,547,198, James Skinner also disclosed that " . . . the dried coal produced by such processes frequently had a tendency to undergo spontaneous ignition and combustion in storage and transit . . . ." In order to minimize this pyrophoricity, Skinner passed the coal through a mist of oil.

In 1986, in U.S. Pat. No. 4,571,174, Walter Shelton disclosed that, in a fluidized bed, dried low rank coal has a tendency to ignite. At column 1 of hs patent, Shelton taught that: "The coal leaving a drying process for the removal of inherent water will typically be at a temperature of from bout 130 to about 250 degrees Fahrenheit. . . . When such processes for the removal of inherent water are applied to low rank coals, the coal has a tendency to ignite in the fluidized bed as a result of the contact between the high temperature gases normally used as a hot fluidizing gas to dry the coal and coal particles which have been dried to a relatively low water content."

It is an object of this invention to provide a process which enables one to simultaneously improve the fuel properties of coal and oil.

It is yet another object of this invention to provide a process for reducing the amount of moisture in coal.

It is yet another object of this invention to provide a dried coal which is substantially non pyrophoric.

It is yet another object of this invention to provide a dried coal with a substantially higher heating value than the parent coal from which it is derived.

It is yet another object of this invention to provide a dried coal which is substantially non deliquescent.

It is yet another object of this invention to provide a process for reducing the amount of sulfur in oil.

It is yet another object of this invention to provide an oil which has a substantially higher A.P.I. gravity than the parent oil from which it is derived.

SUMMARY OF THE INVENTION

In accordance with this invention, there is provided a process for simultaneously improving the fuel properties of coal and oil. In the first step of this process, a first fluidized bed (the reactor vessel) which has a density of from about 20 to about 50 pounds per cubic foot and which is at a temperature of from about 850 to about 1,000 degrees Fahrenheit is provided. In the second step of the process, coal and oil are continuously fed into the reactor vessel while fluidized particles are continuously removed from such vessel. In the third step of the process, the fluidized particles which are removed from the reactor vessel are transferred to a second fluidized bed (the burner vessel); at least a portion of these particles are combusted in the presence of air. In the fourth step of the process, at least a portion of the combusted fluidized particles are returned to the reactor vessel.

BRIEF DESCRIPTION OF THE DRAWING

The present invention will be more fully understood by reference to the following detailed description thereof, when read in conjunction with the attached drawing, wherein like reference numerals refer to like elements, and wherein.

DESCRIPTION OF THE PREFERRED EMBODIMENTS

Figure 1:
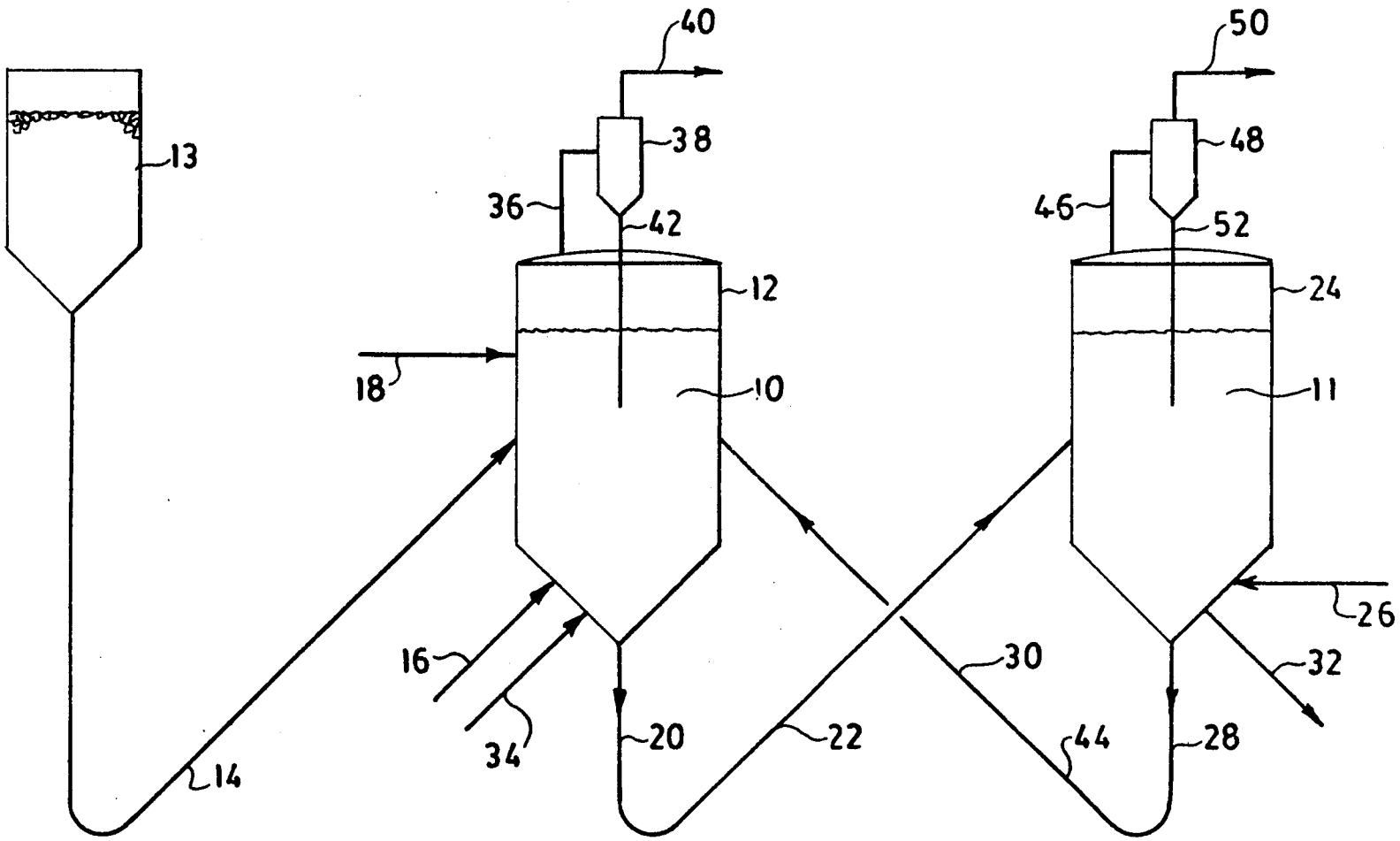
FIG. 1 is a flow diagram illustrating a preferred embodiment of the process of the invention.

FIG. 1 illustrates one preferred embodiment of the process of this invention.

Referring to FIG. 1, a fluidized bed 10 is provided in a reactor vessel 12. This fluidized bed 10 is comprised of hot coal, and it preferably has a density of from about 20 to about 50 pounds per cubic foot. It is preferred that the fluidizing gas be passed through the bed at a velocity of from about 1 to about 5 feet per second.

Fluidized bed 10 may be provided by any of the means well known to those skilled in the art. Thus, for example, one may use the means described in J. M. Coulson et al.'s "Chemical Engineering," Volume Two, Third Edition (Pergamon Press, Oxford, England, 1978, pages 230–280), the disclosure of which is hereby incorporated by reference into this specification; reference may be had, e.g., to pages 272–274 of said book which describes the fluidized bed combustion of coal.

By way of specific illustration and not limitation, fluidized bed 10 may be provided by a process in which sand is first charged into reactor vessel 12 via riser 14; this process also provides a fluidized bed 11 in burner vessel 24. Thereafter, heated air at a temperature of about 1,000 degrees Fahrenheit is injected via line 16 at a fluidizing velocity in the reactor vessel of from about 1 to about 3 feet per second; the air is injected until the temperature of the fluidized sand is about 1,000 degrees Fahrenheit. Thereafter, the air flow is ceased, and oil is added via line 18, thereby forming a fluidized mixture; a portion of this fluidized mixture is then withdrawn through standpipe 20 and passed through riser 22 to burner vessel 24. A portion of the carbonized material in the fluidized mixture in burner vessel 24 is then treated with air injected through line 26 and heated to a temperature which is from about 25 to about 100 degrees hotter than the temperature in reactor vessel 12. A portion of the fluidized material in burner vessel 24 is continually withdrawn through standpipe 28 and passed through riser 30 to reactor vessel 12. A portion of the material in burner vessel 24 is withdrawn through line 32 and discarded to reduce the amount of sand in the system. At about the same time, coal is introduced into reactor vessel 12 via line 14. This process is continued until the beds in reactor vessel 12 and burner vessel 24 consist essentially of carbonaceous material.

Via this startup process, or any other conventional process for providing a fluidized bed, fluidized beds 10 and 11 are provided.

Each of fluidized beds 10 and 11 preferably has a fluidized density of from about 20 to about 50 pounds per cubic foot. As will be apparent to those skilled in the art, the fluidized density is the density of the bed while its materials are in the fluid state and does not refer to the particulate density of the materials in the bed.

Each of fluidized beds 10 and 11 is comprised of at least about 80 weight percent of carbonaceous material. The carbonaceous material may be coal, coke, and mixtures thereof. Non-carbonaceous materials, such as sulfur and ash, also may be present in the bed(s) in minor amounts.

Fluidized beds 10 and 11 are maintained at a temperature of from about 850 to about 1,050 degrees Fahrenheit. Fluidized bed 10 is maintained at a temperature of from about 850 to about 1,000 degrees Fahrenheit, and fluidized bed 11 is maintained at a temperature of from about 850 to about 1,050 degrees Fahrenheit, provided that the temperature of fluidized bed 11 is least about 25 degrees higher than that used in bed 10.

After fluidized bed 10 has been established in a steadystate condition, coal is fed into fluidized bed 10 via line 14, and oil is fed into fluidized bed 10 via line 18. The coal and oil are fed into bed 10 at rates such the feed rate of the coal (in pounds per hour) is from about 0.05 to about 20 times as great as the feed rate of the oil. In one embodiment, the feed rate of the coal is from about 0.1 to about 10 times as great as the feed rate of the oil.

In one embodiment, wherein the primary goal of the process is to upgrade coal, from about 50 to about 90 weight percent of coal (by total weight of coal and oil fed) is fed into the system. In another embodiment, where the primary goal of the system is to upgrade oil, from about 50 to 95 weight percent of oil is fed into the system.

The coal may be fed from any suitable container and by any suitable means. Thus, by way of illustration and referring again to FIG. 1, coal may be stored in hopper 13 and fed via line 14 to reactor vessel 12. Alternatively, coal may be fed via a screw conveyor (not shown), a star feeder (not shown), or any other suitable solid transport device.

In one embodiment, steam is added via line 34 to reactor vessel 12 in order to maintain fluidization of bed 10.

The coal which is added via line 14 may be any of the coals known to those skilled in the art. Thus, by way of illustration, one may treat lignite, subbituminous, bituminous, semibituminous, semianthracite, and anthracite coals. These coals are defined on page 222 of "A dictionary of mining, mineral, and related terms," complied and edited by Paul W. Thrush and the Staff of the Bureau of Mines (Washington, D.C., United States Bureau of Mines, Department of the Interior, 1968), the disclosure of which is hereby incorporated by reference into this specification. Reference also may be had to the International Committee for Coal Petrology's "International Handbook of Coal Petrology" (Centre National de la Recherche Scientifique, Paris, France, 2nd edition, 1963, parts I and II) and to pages 9-3 to 9-5 of Robert H. Perry et al.'s "Chemical Engineers' Handbook," Fifth Edition (McGraw-Hill Book Company, New York, 1973), the disclosure each of of which also is incorporated by reference into this specification.

In one preferred embodiment, the coal used in the process of the invention has a moisture content of at least about 10 weight percent, an ash content of at least about 10 weight percent, and a calorific value of less than about 9,000 British Thermal Units; this coal is described in U.S. Pat. No. 4,052,168, the description of which is hereby incorporated by reference into this specification. This preferred coal is often referred to as subbituminous coal. It is to be understood that these lower-rank coals exhibit the greatest improvement with the process of this invention. However, it will also be apparent to those skilled in the art that higher-rank coals also may be substantially improved with such process.

Any of the mineral oils known to those skilled in the art may be used in the process of this invention. As is known to those skilled in the art, mineral oils are derived from petroleum, coal, shale, and the like and consist essentially of hydrocarbons (see, e.g., page 764 of said "A dictionary of mining, mineral, and related terms," supra.

By way of illustration, liquid petroleum fuels may be used in the process of this invention. These liquid petroleum fuels are described on pages 9-8 through 9-11 of siad "Chemical Engineers' Handbook," supra, the disclosure of which is hereby incorporated by reference into this specification.

It is preferred that the oil used in the process of this invention have an A.P.I. gravity of from about 0 to about 15 As is known to those skilled in the art, A.P.I. gravity is determined at ambient temperature with specialized hydrometers, corrected to 60 degrees Fahrenheit, and expressed in degrees A.P.I., a scale that is related inversely to the specific gravity "s" at 60 degrees/60 degrees F., in accordance with the formula: degrees A.P.I. $= 141.5/s - 131.5$ By way of illustration and not limitation, one may use low gravity crude oils produced in Boscan, Venezuela (which typically have a gravity of 9.5 and contain about 5.2 weight percent of sulfur), in Lagunillas, Venezuela (which typically have a gravity of 10.6 and contain about 2.9 weight percent of sulfur), in Coleville, Canada (which typically have a gravity of 13.5 and contain about 3.2 percent of sulfur), and the like.

In the preferred embodiment illustrated in FIG. 1, reactor vessel 12 is equipped with exit line 36 which conveys reactor products and entrained solids to cyclone 38. Cyclone 38 separates the stream into gaseous hydrocarbon products and water vapor, which are then passed through line 40 to suitable recovery facilities (not shown). The entrained solids separated in cyclone 38 are returned to the fluid bed 10 via standpipe 42.

In one preferred embodiment, not shown, the standpipes and risers are equipped with suitable aeration taps (not shown) to maintain the fluidity of the circulating solids passing through them.

In one embodiment (not shown), instead of introducing the oil via line 18 and the coal via line 14, one or both of these components may be introduced into the lower section of riser 30 at point 44. As will be known to those skilled in the art, different coals and oils have different chemical reactivity rates and, thus, require, different residence times in the system. For those coals and/or oils which are less reactive, it might be advantageous to introduce them into the lower section of riser 30 at point 44 rather than introducing them directly into reactor vessel 12.

It is preferred that, at steady state, the pressure within reactor vessel 12 and within burner vessel 24 be no greater than about 15 p.s.ig.

The reaction occurring in reactor vessel 12 is endothermic. Accordingly, the heat of reaction is preferably supplied by burning a portion of the carbonaceous mixture from reaction vessel 12. A sufficient amount of such material is withdrawn from vessel 12 through standpipe 20 and riser 22 and thereafter burned in burner vessel 24. Inasmuch as the reaction temperature in vessel 24 is from about 25 to about 100 degrees higher than the temperature in vessel 12, combusted material passed from vessel 24 to vessel 12 will provide the heat of reaction required in vessel 12. Those skilled in the art can readily determine temperatures and flow rates needed to achieve a temperature balance within the system.

Carbonaceous material from burner 24 is continuously removed via line 32 in order to maintain a constant unit inventory. Those skilled in the art are well aware of how to balance the flow and discharge rates in order to obtain such inventory.

Burner vessel 24 is comprised of an exit line 46 and a cyclone 48. Exit line 46 carries combustion gases and entrained solids from fluid bed 11 to cyclone 48. Combustion gases exit through line 50, to vent; and entrained solids from cyclone 48 are returned to fluid bed 11 through standpipe 52.

As will be apparent to those skilled in the art, all streams which are significantly above ambient temperature may be connected to suitable heat recovery devices.

In one embodiment of this invention, the the coal used in the process of this invention is pretreated prior to being fed into reactor vessel 12. The coal so pretreated generally contains from about 0.5 to about 3.0 weight percent of oil, from about 10 to about 30 weight percent of moisture, and from about 5 to about 15 weight percent of ash.

A coal which contains from about 0.5 to about 3.0 weight percent of oil, from about 10 to about 30 weight percent of moisture, and from about 5 to about 15 weight percent of ash may be prepared by means well known to those skilled in the art.

By way of illustration, one may prepare such a coal by the process described in U.S. Pat. No. 4,854,940 of Jerzy S. Janiak, et al., the disclosure of which is hereby incorporated by reference into this specification. In the process of this patent, subbituminous coal is agglomerated with a "bridging liquid" consisting essentially of from about 20 to about 50 percent of a light hydrocarbon diluent (e.g., oils such as naptha, kerosene, diesel oil, and the like) and from about 50 to about 80 percent of a low quality heavy oil (e.g., bitumen, heavy crude, and other oils recognized in the art as being heavy oils).

By way of further illustration, the processes of the Lykken patents described elsewhere in this specification may be used to prepare a coal containing from about 3.0 weight percent of oil, from about 10 to about 30 weight percent of moisture, and from about 5 to about 15 weight percent of ash. Thus, for example, one may use the process described in U.S. Pat. No. 2,996,400, the disclosure of which is hereby incorporated by reference into this specification.

By way of further illustration, the processes described in U.S. Pat. Nos. 3,985,516 and/or 3,985,517 may be used in applicant's process.

In one embodiment, the coal which contains from about 0.5 to about 3.0 weight percent of oil, from about 10 to about 30 weight percent of moisture, and from about 5 to about 15 weight percent of ash is preheated to a temperature of from about 250 to about 350 degrees Fahrenehit prior to being introduced into reactor vessel 12.

Thus, by way of illustration and not limitation, and referring to FIG. 1, such coal may be introduced into container 13 by a suitable line. Hot gas (such as, e.g., the exhaust gas from line 50) may be introduced by a line (not shown) into container 13; it is preferred that the velocity of such hot gas be less than about 1.0 foot per second inasmuch as fluidization of the contents of such container need not be vigorous. The off gas from container 13 may be passed to cyclone 38 via a line (not shown). Any entrained solids may be returned to vessel 13 by a standpipe (not shown). Gases containing principally nitrogen, carbon dioxide, water vapor, and hydrocarbons may be transferred to a suitable recovery facility.

The coal in vessel 13, which contained from about 0.5 to about 3.0 weight percent of oil, from about 10 to about 30 weight percent of moisture, and from about 5 to about 15 weight percent of ash prior to the time it was heated to a temperature of from about 250 to about 350 degrees Fahrenheit, may then be fed into reactor vessel 12 and processed in the manner described for other coals elsewhere in this specification.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

I claim:

1. A process for simultaneously improving the fuel properties of coal and oil, comprising the steps of:

(a) providing a heated fluidized bed reactor, wherein said reactor has a fluidized density of from about 20 to about 50 pounds per cubic foot, is comprised of at least about 80 weight percent of carbonaceous material, is at a temperature of from about 850 to about 1,000 degrees Fahrenheit, and is at a pressure no greater than about 15 pounds per square inch gauge;

(b) providing a second heated fluidized bed burner, wherein said burner has a fluidized density of from about 20 to about 50 pounds per cubic foot, is comprised of at least about 80 weight percent of carbonaceous material, is at a pressure of no greater than about 15 pounds per square inch gauge, and is at a temperature of from about 850 to about 1,050 degrees Fahrenheit, providing that the temperature in said burner is at least 25 degrees greater than the temperature in said reactor;

(c) after each of said reactor and said burner has been provided in a steady state condition, coal and oil is fed into said reactor, wherein the feed rate of said coal, in pounds per hour, is from about 0.05 to about 20 times as great as the feed rate of said oil, thereby producing a mixture of solid carbonaceous material and petroleum material wherein said oil has an A.P.I. gravity of less than about 15;

(d) withdrawing at least a portion of said solid carbonaceous material from said reactor and feeding it into said burner;

(e) partially combusting solid carbonaceous material in said burner, thereby producing partially combusted carbonaceous material;

(f) returning a portion of said combusted carbonaceous material from said burner to provide the heat for reaction to said; and (g) continuously removing carbonaceous material at another point from said burner to maintain a constant unit inventory.

2. The process as recited in claim 1, wherein the feed rate of said coal is from about 0.1 to about 10 times as great as the feed rate of said oil.

3. The process as recited in claim 2, wherein from about 50 to about 90 weight percent of coal by total weight of coal and oil fed into said first fluidized bed is fed into said first fluidized bed.

4. The process as recited in claim 1, wherein said coal has a moisture content of at least about 10 weight percent an ash content of at least about 10 weight percent and a calorific value of less than about 9,000 British Thermal Units.

5. The process as recited in claim 1, wherein said coal is comprised of from about 0.5 to about 3.0 weight percent of oil from about 5 to about 15 weight percent of ash.

6. The process as recited in claim 5, wherein, prior to the time said coal is subjected to a temperature of from about 850 to about 1,000 degrees Fahrenheit, it is heated to a temperature of from about 250 to about 350 degrees Fahrenheit.

7. The process as recited in claim 6, wherein said coal is heated to said temperature of from about 250 to about 350 degrees Fahrenheit by being contacted with a hot gas flowing at a rate of less than about 1.0 foot per second.

* * * * *